US007695209B2

(12) United States Patent
Perignon

(10) Patent No.: US 7,695,209 B2
(45) Date of Patent: Apr. 13, 2010

(54) STOPPER FOR THE NECK OF A FLUID PRODUCT RESERVOIR

(75) Inventor: Fabrice Perignon, Verneuil-sur-Avre (FR)

(73) Assignee: Valois SAS, Le Neubourg (FR)

( * ) Notice: Subject to any disclaimer, the term of this patent is extended or adjusted under 35 U.S.C. 154(b) by 642 days.

(21) Appl. No.: 11/578,603

(22) PCT Filed: Apr. 14, 2005

(86) PCT No.: PCT/FR2005/050242

§ 371 (c)(1),
(2), (4) Date: Oct. 16, 2006

(87) PCT Pub. No.: WO2005/105598

PCT Pub. Date: Nov. 10, 2005

(65) Prior Publication Data

US 2009/0014480 A1 Jan. 15, 2009

(30) Foreign Application Priority Data

Apr. 16, 2004 (FR) ..... 04 04023

(51) Int. Cl.
*B43K 5/14* (2006.01)

(52) U.S. Cl. ..... 401/133; 401/132; 401/130; 401/126

(58) Field of Classification Search ..... 401/126–130, 401/132, 133; 215/250, 252; 604/3
See application file for complete search history.

(56) References Cited

U.S. PATENT DOCUMENTS

| | | | | |
|---|---|---|---|---|
| 4,410,096 | A | 10/1983 | Paradis | |
| 4,712,936 | A | 12/1987 | Kessler | |
| 4,732,287 | A | 3/1988 | Bennett | |
| 4,952,204 | A * | 8/1990 | Korteweg | 604/1 |
| 6,186,689 | B1 | 2/2001 | Sheffler et al. | |
| 6,382,438 | B1 * | 5/2002 | Schneider et al. | 215/48 |

FOREIGN PATENT DOCUMENTS

| | | |
|---|---|---|
| DE | 491 938 C | 2/1930 |
| GB | 735 815 A | 8/1955 |

* cited by examiner

*Primary Examiner*—David J Walczak
(74) *Attorney, Agent, or Firm*—Sughrue Mion, PLLC

(57) ABSTRACT

A stopper for mounting on a neck of a fluid reservoir, said stopper including a fastener collar and a closure member, the collar defining an orifice, and the closure member being suitable for closing said orifice. The closure member includes a fluid extractor and/or applicator element that extends through the collar.

22 Claims, 5 Drawing Sheets

STOPPER FOR THE NECK OF A FLUID PRODUCT RESERVOIR

BACKGROUND OF THE INVENTION

1. Field of the Invention

The present invention relates to a stopper for being mounted on a fluid reservoir. The stopper comprises a fastener collar defining an orifice, and a closure member that is suitable for closing said orifice. The present invention also relates to a dispenser provided with such a stopper.

The advantageous fields of application for this kind of stopper are in particular the fields of perfumery and cosmetics. The term "fluid" covers not only liquids that are viscous to a greater or lesser extent, but it also covers powders.

2. Description of the Related Art

Numerous receptacle-closure systems, commonly referred to as stoppers, comprising a closure member that is suitable for being fastened on a collar, so as to prevent fluid contained in a receptacle from escaping, are known in the prior art. For example, in the field of perfume or cosmetics samples, dispensers are known, commonly referred to as sample bottles, that present a reservoir having a capacity lying in the range about 2 milliliters (mm) to 3 mm, and that are provided with a stopper including a removable cap. The cap can also be fastened on a collar mounted on the neck of the sample bottle. In a variant, the cap can simply be pressed onto the neck, or into the neck, of the sample bottle. Screw-fastening can also be used, so as to fasten the cap on the collar or the neck of the sample bottle. Thus, in order to dispense a measured quantity of fluid, it suffices to remove the cap by unscrewing it or by pulling it off, and then to tilt or turn the dispenser upsidedown, so as to extract the fluid contained in the reservoir. The fluid contained in the reservoir, which can be a cream, a lotion, a perfume, or a powder, is thus generally collected by the user on the end of the fingers, and then applied to an application surface, in general the skin. Thus, a problem associated with the use of such sample bottles resides in the non-reproducibility of the quantity of fluid that is dispensed, and more generally in the inaccuracy of the quantities extracted. Another problem is associated with the use of the fingers, firstly they become impregnated, and secondly they can pollute the fluid in the sample bottle.

BRIEF SUMMARY OF THE PREFERRED EMBODIMENTS OF THE INVENTION

An object of the present invention thus consists in improving existing dispenser devices.

Another object of the present invention is to remedy those prior-art drawbacks by using a dispenser including a stopper that is capable of extracting fluid in more precise and reproducible manner, and without using the fingers of the user.

Another object of the present invention is also to develop a stopper that is easy to manufacture and to assemble, and that is of low cost.

Leaktight fastening the cap on the neck or on the collar is another problem.

To achieve these objects, the present invention provides a stopper for mounting on a neck of a fluid reservoir, said stopper comprising a fastener collar and a closure member, the collar defining an orifice, and the closure member being suitable for closing said orifice, the stopper being characterized in that the closure member includes a fluid extractor and/or applicator element that extends through the collar. The extractor and/or applicator element is for dipping into the fluid contained in the reservoir or in the sample bottle.

Advantageously, said extractor and/or applicator element includes fluid-retention means. They may be in the form of grooves or splines, for example.

Advantageously, said collar includes a ring provided with a snap-fastener profile that is suitable for snap-fastening in a corresponding recess of said neck, so as to hold said collar on said neck.

Advantageously, said collar includes a sealing skirt that is suitable for coming into sealing contact in said neck.

According to another particularly advantageous characteristic, said collar and said closure member are made as a single part, being connected together via a material bridge that breaks during first use. This single-part embodiment thus provides a first-use guarantee, guaranteeing to the user that the purchased device is being used for the first time. The material bridge also guarantees that the dispenser is completely sealed before being used for the first time.

Advantageously, the orifice of the collar is defined by a peripheral edge that is connected via said material bridge to a junction surface of the extractor and/or applicator element. In other words, the collar is initially connected via a part to the closure member, and after the closure member has been removed, said collar defines a peripheral edge forming the dispenser orifice. The collar can be connected to the closure member other than at the extractor element.

Advantageously, said peripheral edge is suitable for coming into sealing contact against a sealing surface of said extractor and/or applicator element after said material bridge has been broken. This constitutes a sealed closed position after first use.

Advantageously, said extractor and/or applicator element includes a snap-fastener bead that is suitable for co-operating with said peripheral edge, so as to hold it in sealing contact against the sealing surface in the closed position.

Advantageously, said snap-fastener bead is situated between the junction surface and the sealing surface.

Advantageously, said closure member includes a handle for being held by a user, said handle including a step wall that is situated facing said collar, said step wall being remote from said collar before the material bridge has been broken, and coming into abutment or into contact with said collar after the material bridge has been broken, and snap-fastening the peripheral edge between said snap-fastener bead and said step wall.

Advantageously, said sealing surface is located between said snap-fastener bead and said step wall.

Advantageously, said handle includes two faces that are mirror images, each presenting a concave surface, making it easier to hold and to remove the closure member.

Preferably, said orifice presents a diameter such that the fluid contained in the reservoir is retained by capillarity in said orifice when said stopper is turned upsidedown. The stopper can thus be used as an applicator.

Advantageously, said orifice presents a diameter that is advantageously in the range 2 mm to 6 mm, and preferably in the range 3 mm to 4 mm.

The present invention also provides a dispenser comprising a fluid reservoir, and a stopper as defined above, mounted on said reservoir, said extractor and/or applicator element extending inside the reservoir to about half-way up said reservoir. The free bottom end of the extractor element may also end further up or further down, e.g. towards the bottom wall of the reservoir.

BRIEF DESCRIPTION OF THE DRAWINGS

The invention is described more fully below with reference to the accompanying drawings which show an embodiment of the invention by way of non-limiting example.

In the figures.

DETAILED DESCRIPTION OF NON-LIMITING EMBODIMENTS OF THE INVENTION

Figure 1A:
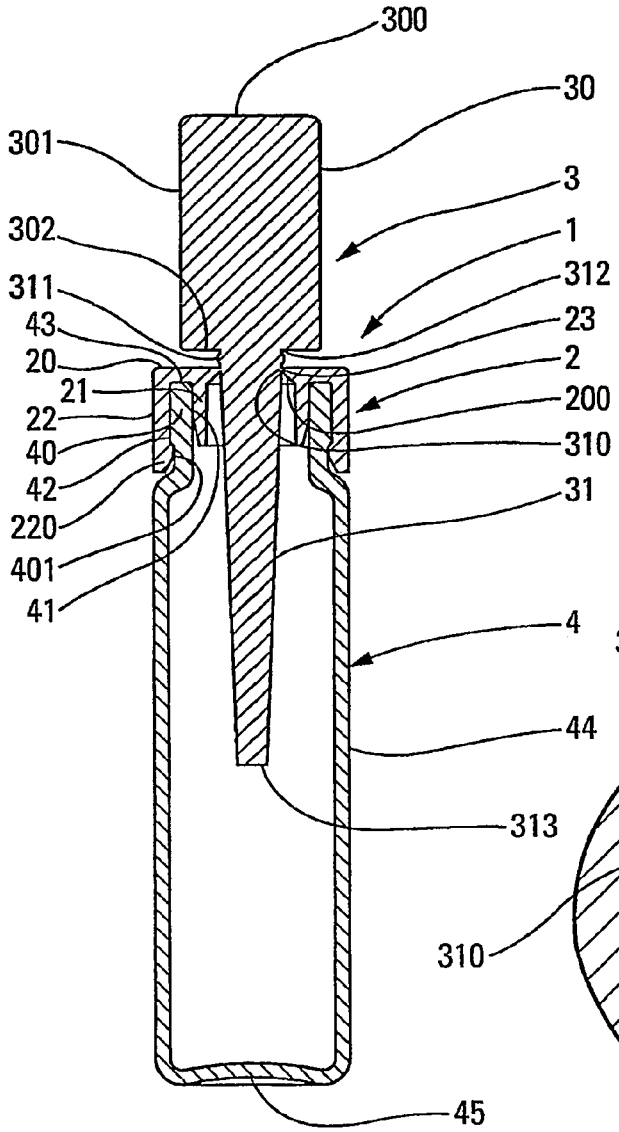
FIG. 1*a* is a vertical section view through a fluid dispenser including a stopper of the invention before first use.

With reference to the figures, the fluid dispenser of the invention comprises a reservoir 4 and a stopper 1.

The reservoir 4 for containing fluid such as a cream, a lotion, or a perfume can be made of glass or of plastics material. The reservoir 4 includes a neck 40 forming an opening for putting the inside of the reservoir into communication with the outside. The neck 40 comprises: an inner wall 41 that is situated in the opening of the neck; a top end 43; and an outer wall 42. A recess 401 is formed in the outer wall 42. The reservoir also includes a cylinder 44 that is closed by a bottom wall 45. By way of example, the outer wall of the cylinder 44 can by circularly cylindrical. The capacity of the reservoir is generally of the order of a few milliliters.

The stopper 1 includes two component elements, namely a fastener collar 2, and a closure member 3.

The fastener collar 2 comprises a radial disk 20, a sealing skirt 21, and a fastener ring 22.

The radial disk 20 forms a top surface that is advantageously circular and plane.

The sealing skirt 21 extends axially downwards from the radial disk 20.

The ring 22 extends axially from the outer periphery of the radial disk 20, coaxially about the sealing skirt 21, and includes a bottom end provided with a snap-fastener profile 220 that projects inwards.

Thus, when the collar 2 is mounted on the neck 40 of the reservoir 4, the ring 22 is in contact with the outer wall 42, and the snap-fastener profile 220 is thus engaged in the recess 401. The ring 22 advantageously extends in alignment with the cylinder 44, thereby advantageously imparting a generally-tubular appearance. The radial disk 20 is advantageously disposed in such a manner as to come to rest on the top end 43 of the neck. The sealing skirt 21 itself comes to be housed in the opening of the neck, advantageously in sealing contact with the inner wall 41, so as to avoid any possibility of leaks/leakage between the neck and the collar.

The closure member 3, preferably made of plastics material, comprises a handle 30, and a fluid extractor and/or applicator element 31.

Figure 3:
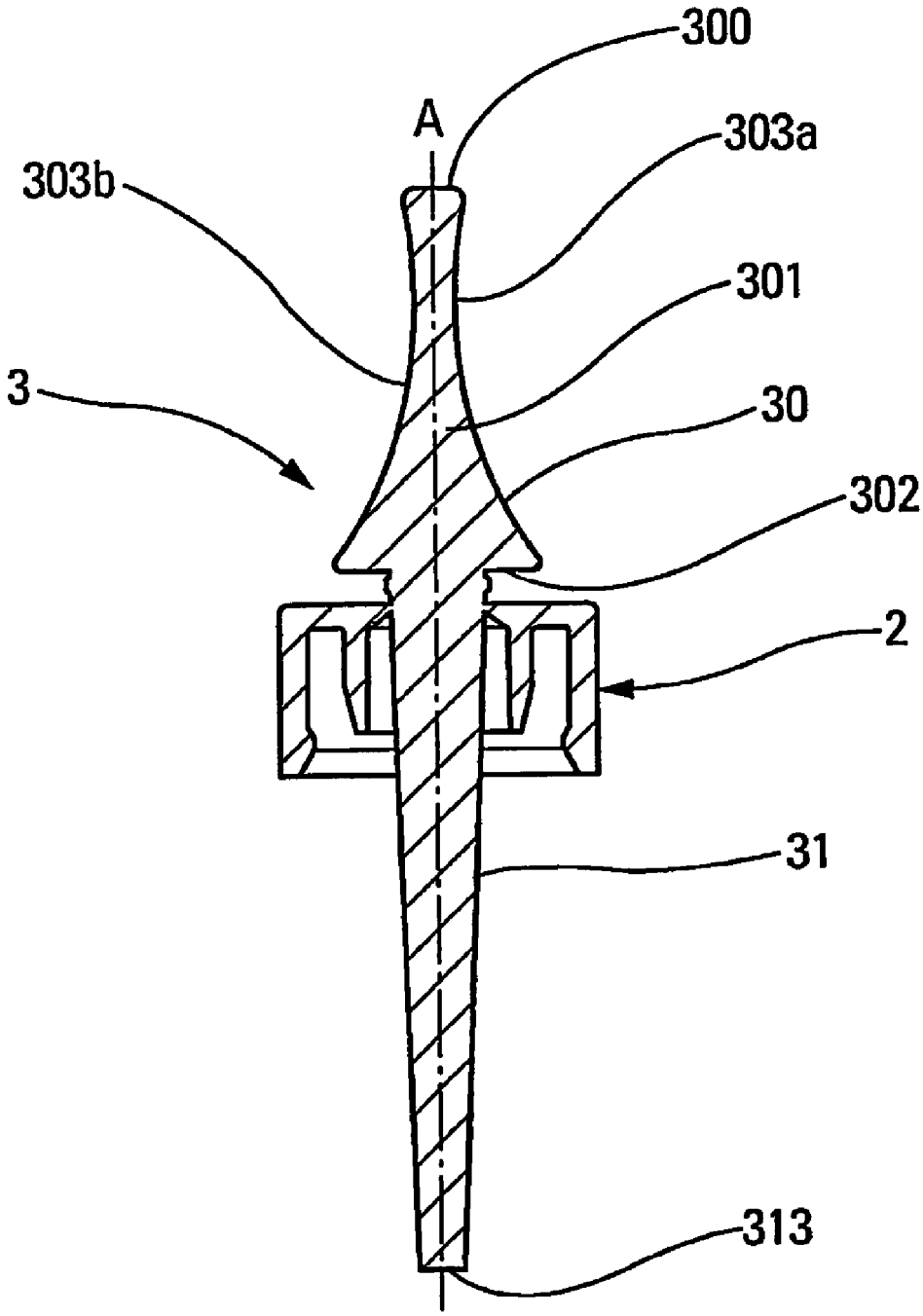
FIG. 3 is a side view in vertical section showing a fluid dispenser including a stopper of the invention before use.

The handle 30 for being held by a user while fluid is being applied, can present any appropriate shape. In a preferred embodiment, the handle 30 includes a top 300 from which there extend two opposite sides 301, and two faces 303*a* and 303*b* that are also situated opposite from each other. The sides 301 and the faces 303*a* and 303*b* thus form four panels leading to a step wall 302. As can be seen in FIG. 3, which shows a dispenser in profile, the faces 303*a* and 303*b* extend from the top 300 to the step wall 302, being arranged between the sides 301. The faces 303*a* and 303*b* present a curved shape, and more particularly a concave shape. Since the top 300 presents a width that is less than the step wall 302, the faces 303*a* and 303*b* thus diverge to a greater extent at the step wall 302. In this preferred embodiment, the faces 303*a* and 303*b* thus form two faces that are mirror images about a plane of symmetry A passing axially through the sides 301 of the closure member 3. This embodiment is particularly advantageous, making it easier to hold the closure member 3 in the hand, and to remove it from the reservoir 4.

The extractor and/or applicator element 31 has the function of making it possible to extract a given quantity of fluid. The element 31 presents a generally-cylindrical configuration that is advantageously frustoconical, but this configuration is not limiting, and numerous shapes can be envisaged. The section of the element 31 preferably decreases smoothly, going from the handle.

The extractor element 31 also has the function of making it easier to put the closure member back into place on the collar.

The element 31 advantageously includes a free bottom end 313, a junction surface 310, a snap-fastener bead 311, and a sealing surface 312.

Figure 4:
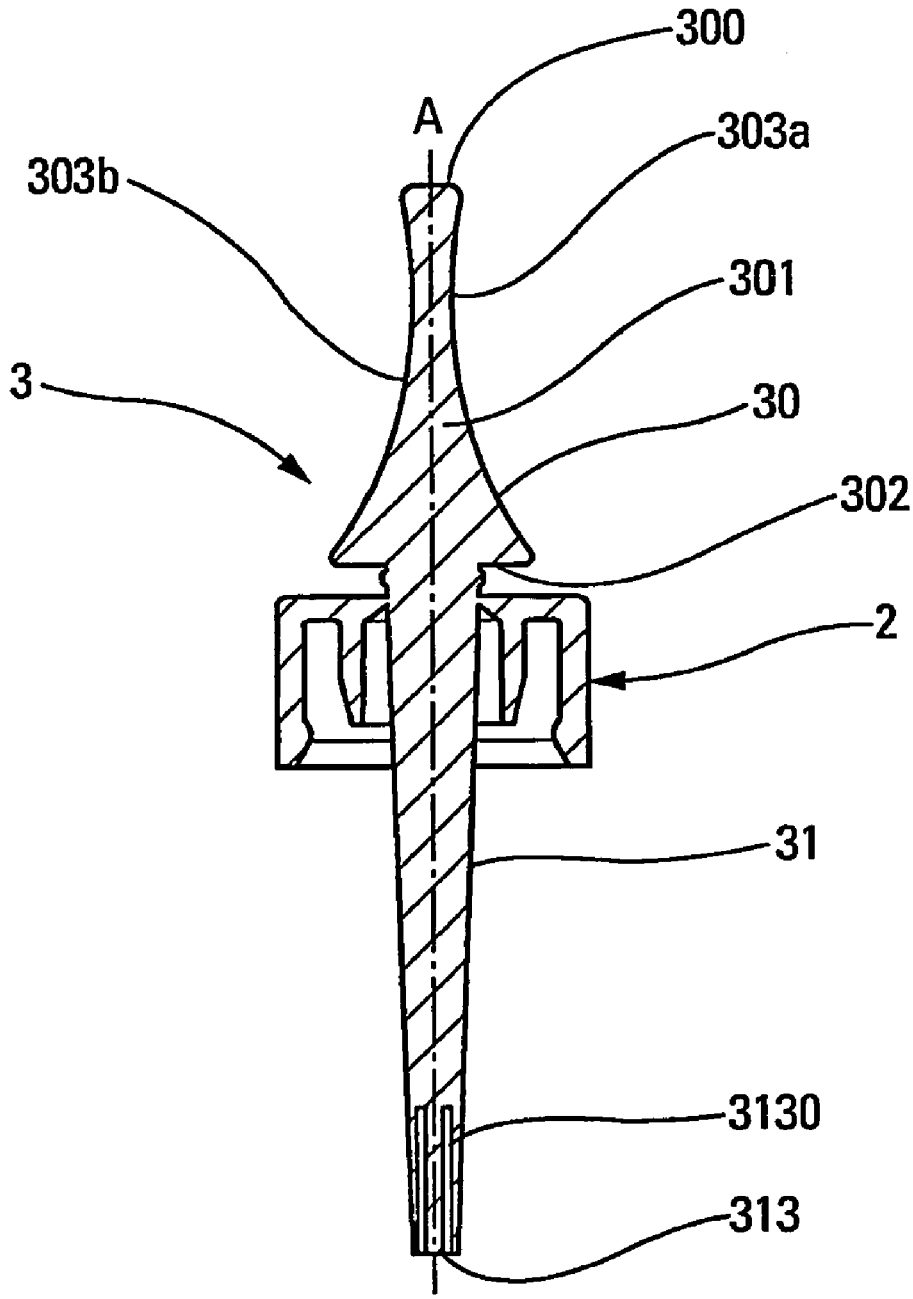
FIG. 4 is a view similar to FIG. 3, presenting a variant embodiment of the stopper of the invention.
Figure 5:
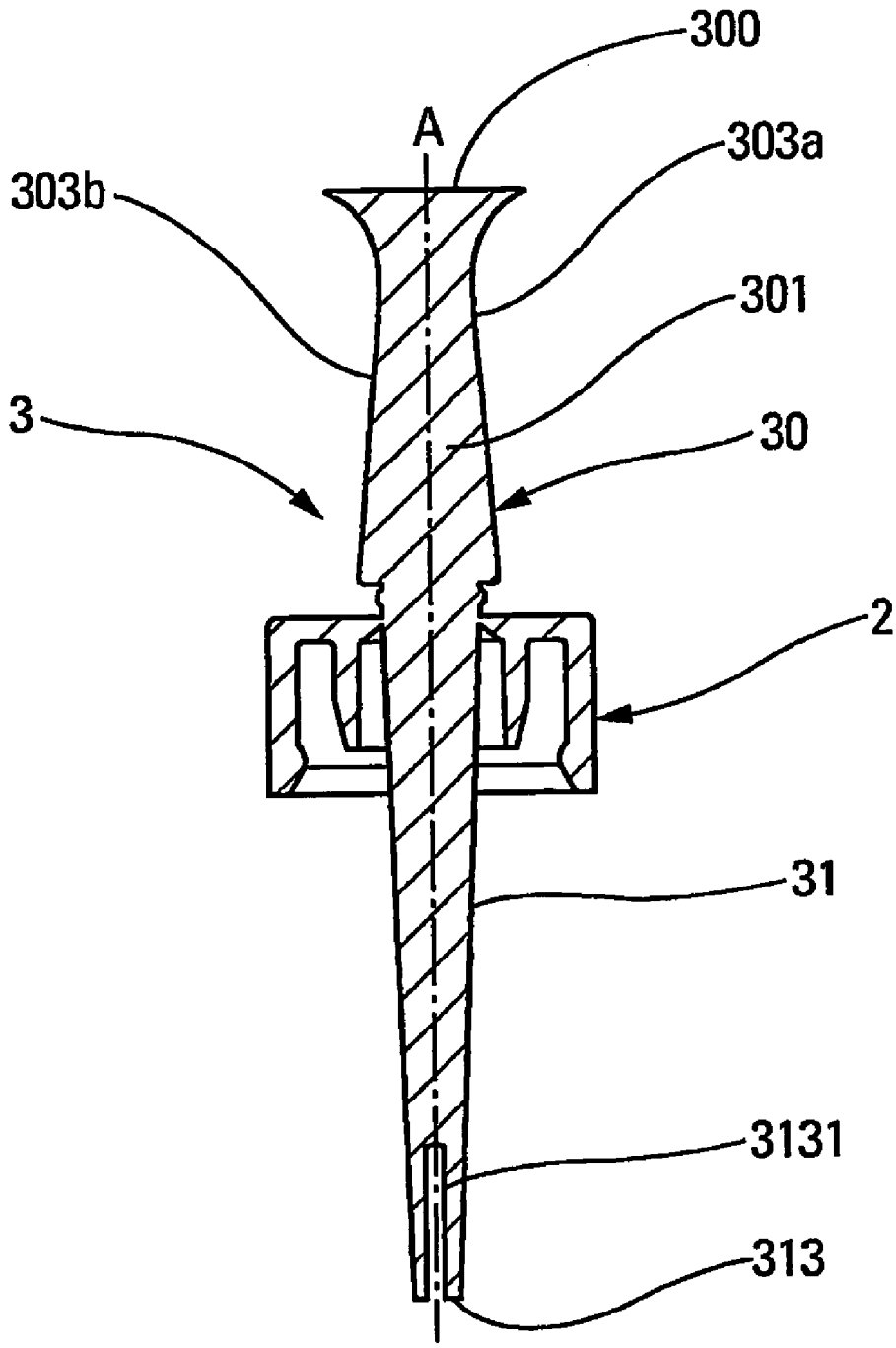
FIG. 5 is a view that is also similar to FIG. 3, presenting another variant embodiment of the stopper of the invention.

The free bottom end 313 can include fluid-retention means. The retention means can be one or more longitudinal grooves 3130, as shown in figure 4, or they can be a slot 3131, as shown in FIG. 5, passing right through the bottom end 313. However, other embodiments of means for guaranteeing the retention of fluid can be envisaged, such as a retention loop, a brush, a pad, or a flexible endpiece, for example.

The junction surface 310 is a circularly-cylindrical surface that extends over the periphery of the element 31.

The snap-fastener bead 311 forms an annular flange projecting radially from the element 31.

The sealing surface 312 itself also corresponds to a circularly-cylindrical surface that extends over the periphery of the element 31.

The junction surface 310 and the sealing surface 312 are advantageously situated on either side of the snap-fastener bead 311. In the embodiment shown in the various figures, the junction surface 310 is situated between the free bottom end 313 of the element 31 and the snap-fastener bead 311, whereas the sealing surface 312 is located between the snap-fastener bead 311 and the step wall 302 of the handle. The sealing surface 312 thus defines a sealing snap-fastener housing between the bead 311 and the step wall 302.

The element 31 advantageously extends from the step wall 302, through the collar 2, to about half-way up the reservoir 4. However, it should be observed that the depth to, which the free end 313 of the element 31 extends can vary greatly. The element 31 can be a very short stem that does not go beyond the end of the collar 2, or, in contrast, it can be a very long stem, almost coming into contact with the bottom wall of the reservoir 4.

Figure 1B:
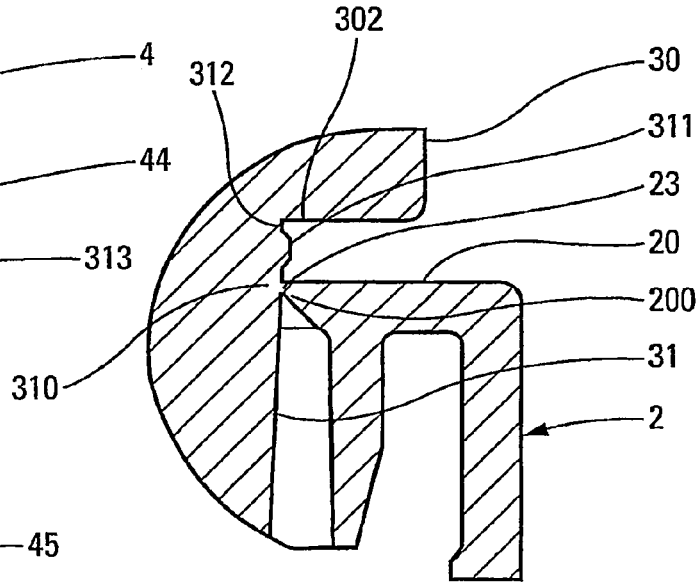
FIG. 1*b* is a larger-scale view of a portion of the stopper shown in FIG. 1*a;*

The closure member 3 is advantageously made as a single part with the collar 2. As shown in FIGS. 1*a* and 1*b*, the closure member 3, on being unmolded, is connected via an annular material bridge 23 to the collar 2. More precisely, the material bridge 23 connects the junction surface 310 of the element 31 to a peripheral edge 200 formed by the radial disk 20. This configuration has the advantage of guaranteeing first use, with it not being possible to extract the fluid contained in the reservoir 4 before the material bridge 23 has been broken.

During first use, the material bridge must thus be broken. Breakage is performed by a traction, thrust, or turning movement of the closure member 3 relative to the collar. Such breakage thus has the effect of creating an orifice 24 that is defined by the peripheral edge 200 of the radial disk 20. The closure member 3 can thus be removed freely from the reservoir 4 and from the collar 2. This configuration thus gives rise, in the open position, to a closure member 3 that is compatible with extracting and applying fluid. It should be noted that the orifice 24 is advantageously formed in the center of the radial disk 20, and that the orifice presents any appropriate shape: circular, oblong, elliptical, etc. However, the dimension of the orifice 24 is advantageously such that the fluid is retained by capillarity in the orifice if the dispenser is tilted, or even turned upsidedown. Thus, this characteristic means that the collar 2 itself can be used as an applicator element. To do this, the orifice 24 advantageously presents a diameter that is small, lying in the range about 2 mm to 6 mm, and preferably about 3 mm to 4 mm.

It should be noted that the peripheral edge forming the orifice serves initially as a fastener point for the breakable material bridge, and then as an annular sealing zone that co-operates with the sealing surface 312 of the closure member.

In addition, it should be noted that the element 31 need not be used for extracting and applying fluid, but could be used merely as a guide stem, making it easier to put the closure member back into place once dispensing has been completed. Once dispensing has been completed, the closure member 3 is replaced in such a manner as to close the orifice 24. Naturally, the element 31 makes it easier to reposition the closure member, since it suffices to release the element 31 in the orifice 24, so as to guide the closure member relative to the collar.

Figure 2A:
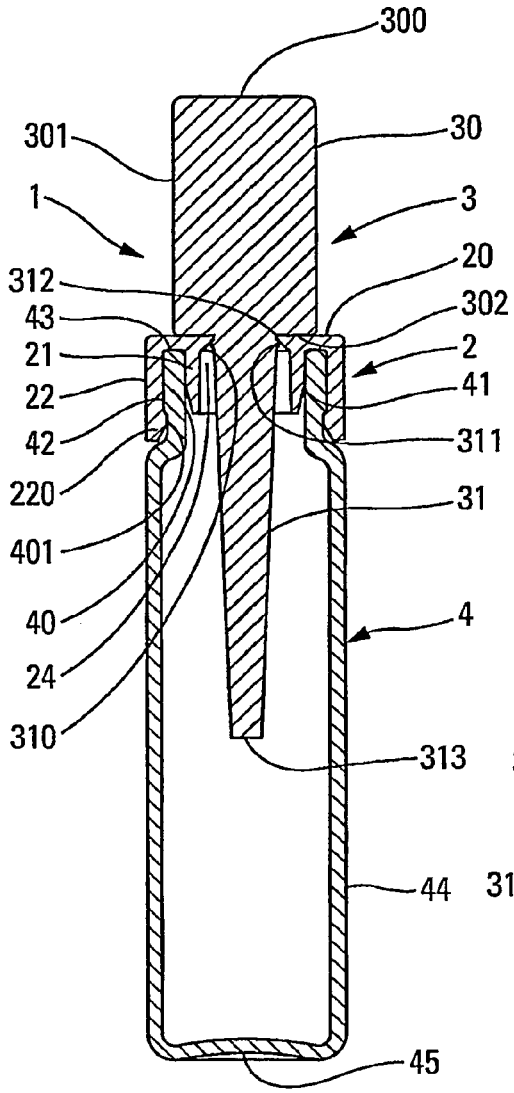
FIG. 2*a* is a view similar to FIG. 1*a* with the stopper in its closed position.
Figure 2B:
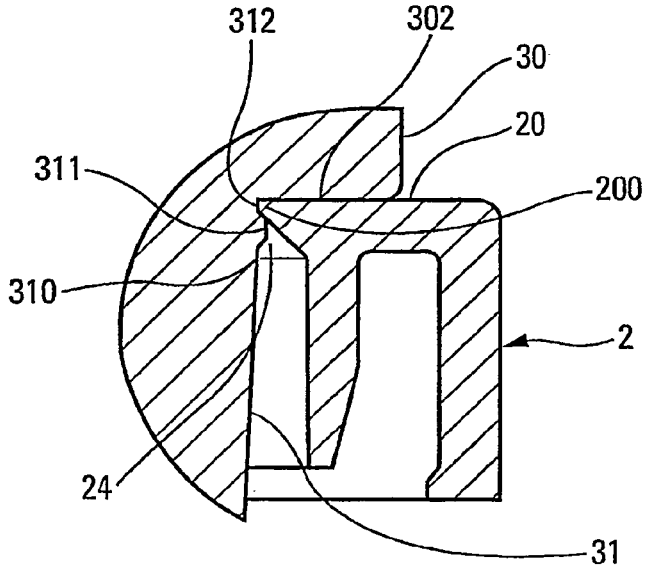
FIG. 2*b* is a view similar to FIG. 1*b*, in the closed position shown in FIG. 2*a;*

The closure member can be put back into place. The closure member can thus define a closed position as shown in FIGS. 2*a* and 2*b*. This position enables the closure member 3 to be securely held on the collar 2. To do this, a snap-fastener system is provided. The snap-fastener system involves the peripheral edge 200 of the collar 2 co-operating with the snap-fastener bead 311 of the element 31. This co-operation takes place as a result of the closure member being pressed hard enough for the peripheral edge 200 to pass over the snap-fastener bead 311. Once the snap-fastener bead 311 has been passed over, the peripheral edge 200, that is retained by the snap-fastener bead 311, holds the closure member in its closed position. In this position, the peripheral edge 200 is thus in sealing engagement with the sealing surface 312 of the element 31, thereby avoiding any possibility of fluid leaking between the element 31 and the collar 2.

Furthermore, it should be noted that, in this position, it is possible to avoid any slack or relative axial displacement between the closure member 3 and the collar 2. The step wall 302 of the handle, that both in the initial position and in the open position is situated remote from the radial disk 20, can come into abutment against the radial disk once the snap-fastener bead 311 has been passed over in the closed position. The clearance between the closure member 3 and the collar 2 could thus be small if the peripheral edge 200 of the radial disk 20 presents a height that is substantially equal to the height of the sealing surface 312.

FIG. 5 shows another configuration for the handle 30. The faces 303*a* and 303*b* are less concave, but present a top portion that makes it easier to hold the closure member while pulling it so as to remove it from the orifice of the collar.

Finally, when it is desired by the user to return to the open position, simple traction exerted on the closure member 3 enables the peripheral edge 200 to pass over the snap-fastener bead 311, thereby enabling the element 31 to be removed.

Although the present invention is described above with reference to a particular embodiment thereof, the invention is naturally not limited by the examples described above. On the contrary, any useful modification could be applied thereto by a person skilled in the art, without going beyond the ambit of the present invention, as defined by the accompanying claims.

The invention claimed is:

1. A perfume dispenser comprising:

a perfume reservoir (4) comprising a neck (40) forming an opening, the reservoir being substantially rigid and containing perfume; and a stopper (1) mounted on the neck (40) of the reservoir (4), said stopper comprising a fastener collar (2) and a closure member (3), the collar being fastened on the neck of the reservoir, the collar (2) defining an orifice (24), and the closure member (3) being suitable for closing said orifice (24), the closure member (3) including a perfume extractor element (31) that extends through the collar (2);

said collar (2) and said closure member (3) being made as a single part, being connected together via a material bridge (23) that breaks during first use, the orifice (24) of the collar (2) being defined by a peripheral edge (200) that is connected via said material bridge (23) to a junction surface (310) of the extractor and/or applicator element (31), the stopper being characterized in that said peripheral edge (200) is suitable for coming into sealing contact against a sealing surface (312) of said extractor and/or applicator element (31) after said material bridge (23) has been broken.

2. The dispenser according to claim 1, in which said extractor element (31) includes perfume-retention means (3130; 3131).

3. The dispenser according to claim 1, in which said collar (2) includes a ring (22) provided with a snap-fastener profile (220) that is suitable for snap-fastening in a corresponding recess (401) of said neck (40), so as to hold said collar (2) on said neck (40).

4. The dispenser according to claim 1, in which said collar (2) includes a sealing skirt (21) that is suitable for coming into sealing contact in said neck (40).

5. The dispenser according to claim 1, in which said extractor element (31) includes a snap-fastener bead (311) that is suitable for co-operating with said peripheral edge (200), so as to hold the extractor element in sealing contact against the sealing surface (312) in the closed position.

6. The dispenser according to claim 5, in which said snap-fastener bead (311) is situated between the junction surface (310) and the sealing surface (312).

7. The dispenser according to claim 5, in which said closure member (3) includes a handle (30) for being held by a user, said handle (30) including a step wall (302) that is situated facing said collar (2), said step wall (302) being remote from said collar (2) before the material bridge (23) has been broken, and coming into contact with said collar (2) after the material bridge (23) has been broken, and snap-fastening the peripheral edge (200) between said snap-fastener bead (311) and said step wall (302).

8. The dispenser according to claim 7, in which said sealing surface (312) is located between said snap-fastener bead (311) and said step wall (302).

9. The dispenser according to claim 7, in which said handle (30) includes two faces (303*a*, 303*b*) that are mirror images, each presenting a concave surface, making it easier to remove the closure member (3).

10. The dispenser according to claim 1, in which said orifice (24) presents a diameter such that the fluid contained in the reservoir (4) is retained by capillarity in said orifice (24) when said stopper (1) is turned upsidedown.

11. The dispenser according to claim 1, in which said orifice (24) presents a diameter that is advantageously in the range 2 mm to 6 mm.

12. The dispenser according to claim 1, wherein the perfume extractor element is configured to be used as a perfume applicator element to apply perfume.

13. The dispenser according to claim 1, wherein the orifice presents a diameter that is in the range of 3 mm to 4 mm.

14. The dispenser according to claim 1, wherein the extractor element extends past the neck into the reservoir.

15. The dispenser according to claim 14, wherein the neck is narrower than the reservoir.

16. The dispenser according to claim 1, wherein the perfume extractor element extends at least half-way into the reservoir.

17. The dispenser according to claim 1, wherein the reservoir is configured to remain rigid upon being squeezed.

18. A perfume dispenser comprising:

a rigid reservoir for containing perfume and comprising a neck forming an opening, wherein the reservoir contains perfume;

a stopper mounted on the neck of the reservoir, wherein the stopper comprises:

a fastening collar fastened to the neck of the reservoir, wherein the fastening collar comprises an orifice, the orifice defined by a peripheral edge; and a closing member comprising a perfume extractor, wherein the closing member closes the orifice;

a material bridge that connects the closing member to the peripheral edge of the orifice on the fastening collar, such that the fastening collar and the closing member are integrally formed;

wherein the material bridge is configured to break during a first use of the dispenser;

wherein said peripheral edge is configured to come into sealing contact against a sealing surface of said closing member after the material bridge has been broken.

19. The perfume dispenser according to claim 18, wherein the perfume extractor extends past the neck into the reservoir.

20. The dispenser according to claim 19, wherein the neck is narrower than the reservoir.

21. The dispenser according to claim 18, wherein the perfume extractor extends at least half-way into the reservoir.

22. The dispenser according to claim 18, wherein the reservoir is configured to remain rigid upon being squeezed.

* * * * *